United States Patent [19]

Asami et al.

[11] Patent Number: 5,060,274

[45] Date of Patent: Oct. 22, 1991

[54] HYDROSTATIC SPEAKER AND SPEAKER DRIVER

[75] Inventors: Shuji Asami, Yokohama; Hitoshi Kitayama, Kodaira, both of Japan

[73] Assignee: Ishikawajima-Harima Heavy Industries Co., Ltd., Tokyo, Japan

[21] Appl. No.: 361,164

[22] Filed: Jun. 5, 1989

[30] Foreign Application Priority Data

Jun. 10, 1988 [JP] Japan ..... 63-141755

[51] Int. Cl.[5] ..... H04R 25/00

[52] U.S. Cl. ..... 381/166; 381/165

[58] Field of Search ..... 381/166, 165, 167, 96

[56] References Cited

U.S. PATENT DOCUMENTS

| | | | |
|---|---|---|---|
| 2,616,984 | 11/1952 | Pare | 381/165 |
| 4,194,095 | 3/1980 | Doi et al. | 381/165 |
| 4,281,666 | 8/1981 | Cosman | 128/748 |
| 4,514,599 | 4/1985 | Yanogishima et al. | 381/86 |

FOREIGN PATENT DOCUMENTS

| | | | |
|---|---|---|---|
| 2269267 | 11/1975 | France | 381/96 |
| 2498866 | 7/1981 | France | 381/167 |
| 46-13470 | 4/1971 | Japan | 381/166 |
| 47-45537 | 11/1972 | Japan | 381/166 |
| 59-153398 | 9/1984 | Japan | 381/96 |
| 60-21000 | 10/1985 | Japan . | |
| 60-259097 | 12/1985 | Japan | 381/165 |
| 62-115994 | 5/1987 | Japan | 381/96 |
| WO8400274 | 1/1984 | PCT Int'l Appl. | 381/96 |

*Primary Examiner*—Jin F. NG
*Assistant Examiner*—Jason Chan
*Attorney, Agent, or Firm*—Dykema Gossett

[57] ABSTRACT

A hydrostatic speaker includes an oscillator, a partition diaphragm disposed in the oscillator to divide the oscillator into two chambers, at least one of which chambers serves as a fluid chamber to cause the partition diaphragm to vibrate in response to external signals from a source, an acoustic sound radiation core connected with the partition diaphragm via a rod, a sensor for detecting fluid pressure in the fluid chamber and another sensor for detecting a movement of the partition diaphragm. The hydrostatic speaker is provided with a speaker driver which includes a fuild pressure controller connected to a pressure source for controlling the fluid pressure in the fluid chamber, and a control amplifier for controlling the fluid pressure controller in accordance with the external signals. Signals detected by the pressure sensor and the position sensor are respectively input as feedback signals to the control amplifier in order to improve controllability, to reduce noises due to pressure fluctuation in the pressure source, and to improve a neutral positioning of the partition diaphragm. The hydrostatic speaker can radiate super low-frequency sound, which has been considered difficult by conventional speakers.

16 Claims, 2 Drawing Sheets

HYDROSTATIC SPEAKER AND SPEAKER DRIVER

BACKGROUND OF THE INVENTION

1. Technical Field

The present invention relates to an electro-acoustic transducer or a so-called speaker, which is a kind of acoustic equipment and a speaker driver, and more particularly to a speaker suitable for radiation of super low-frequency sound and a driver arrangement therefor.

2. Background Art

Generally, speakers used for acoustic radiation are dynamic speakers (DS) having a construction shown in FIG. 4 of the accompanying drawings. In this type of speaker, a magnet M and a yoke Y are employed for forming a powerful magnetic field across a voice coil VC. When alternating current is supplied to the voice coil VC, a core B connected to the voice coil VC starts vibrating, as indicated by the arrow, with the voice coil VC, thereby radiating a sound wave. The moving part of the dynamic speaker DS is held by a damper D, forming a single oscillation system as a whole.

The dynamic speaker DS generally possesses a frequency-sound pressure characteristic as shown in FIG. 5, as long as the electrical input is fixed. The speaker of this type therefore has been widely used as acoustic equipment. In regard to such characteristic, other types of speakers have a similar tendency.

However, as shown in FIG. 5, the electro-acoustic conversion efficiency suddenly drops below the lowest resonance frequency fo, and therefore the above-described dynamic speaker is unsuitable for use in the radiation of a super low-frequency sound below 50 Hz. As a method of lowering the lowest resonance frequency fo, consideration might be given to increasing the weight of the oscillation system or reducing the strength of the damper. These measures, however, are likely to lower the electro-acoustic conversion efficiency and damping qualities. Furthermore, it is not necessarily totally effective if the electrical input is increased in an attempt to compensate for the lowered efficiency because the exoergic of the voice coil increases.

SUMMARY OF THE INVENTION

One object of the present invention is to provide a speaker suitable for the radiation of super low-frequency sound, which heretofore has been considered difficult to achieve because of the intrinsic characteristics of the speaker itself.

The speaker of the present invention is a hydrostatic speaker of such a construction that the super low-frequency sound is radiated by the core driven by a fluid power driver. Specifically, an oscillator of the speaker is separated into two sections, front and rear, by a moving body, and one of two sections is used as a fluid pressure chamber for vibrating the movable body in accordance with external signals given to the moving body in the form of fluid pressure. The moving body is connected to the core for acoustic radiation, such that the low-frequency sound is radiated by the core. There may be provided, when necessary, a fluid pressure sensor for detecting the fluid pressure in the fluid pressure chamber and a position sensor for detecting the position of the moving body and other parts which move with the moving body.

As another mode of the hydrostatic speaker, both front and rear chambers of the oscillator are used as fluid pressure chambers to vibrate the aforesaid moving body in accordance with the external signals. Also, when necessary, there may be provided a differential pressure sensor for detecting a pressure difference between two fluid chambers and the above-mentioned position sensor.

The fluid-power driver for the speaker drives the core for the radiation of a low-frequency sound. The driving power source employed is a fluid pressure source, not an electromagnetic force source. The speaker of the present invention, therefore, can produce a high output for the radiation of a super low-frequency sound, that is, the speaker can serve as a low-sound speaker.

The fluid pressure in the fluid pressure chamber defined in a front or rear half of the oscillator varies with the signals, thereby vibrating the moving body. Vibrations thus produced are transmitted to the acoustic radiation core connected with the moving body, thereby radiating a low-frequency sound from the core. The moving body can be any type of diaphragm, bellows and piston; two fluid pressure chambers may be formed at the front and rear of the moving body, so that the moving body operates in accordance with a differential pressure between two chambers.

Since the speaker is operated by a fluid pressure, not by an electromagnetic force, and the fluid pressure system has intrinsically powerful driving and damping forces, the speaker can perform powerful sound radiation in a super low-frequency range between approximately 0 Hz to 100 Hz. The frequency-sound pressure characteristics of the speaker are adjustable to low-pass characteristics under the power control. Thus, in combination with a conventional speaker, the speaker of the present invention yields a wider-band acoustic system.

The speaker driver of the present invention has a fluid pressure sensor (a differential pressure sensor in a case of a two-chamber type) which detects chamber pressures of the hydrostatic speaker, a fluid pressure controller connected to a fluid power source which controls the chamber pressures of the hydrostatic speaker, and a control amplifier which controls the pressure controller in accordance with the signals; thus, the construction of the hydrostatic speaker is such that a signal from the fluid pressure sensor (the differential pressure sensor) is input to the control amplifier as a feedback signal in order to improve controllability as well as to prevent the occurrence of noise likely to be caused by pressure vibration at a fluid power source. The detection signal from the fluid pressure sensor or the differential pressure sensor is fed back to the control amplifier, thereby eliminating pulsation within the low-frequency range.

Furthermore, the hydrostatic speaker of the above-mentioned construction can be modified by providing a position sensor with the moving body or related parts operating together with the moving body. In this case, a detection signal from the position sensor is input as a feedback signal to the control amplifier in order to improve the response and the positioning of the moving body, i.e., to keep the moving body at the neutral position when no signal is present.

The fluid power source of the speaker driver preferably includes a pump which produces little pulsation, an accumulator, and a pressure regulator. The use of a pump having little pulsation eliminates the pulsation of the fluid pressure, with the result that high-frequency noise components can be removed.

Furthermore, in the construction of the speaker driver provided with the position sensor, because a detection signal from the position sensor is fed back as a feedback signal to the control amplifier in the form of a displacement signal (or speed and acceleration signals if a differentiator is provided), the response characteristics of the speaker driver can be improved. In addition, the moving body can be kept in a neutral position in the absence of a signal, and the drift of the fluid pressure (differential pressure) sensor is cancelled.

Also, in the speaker driver, pulsation and, particularly, high-frequency pressure noises can be removed by using for example a screw pump as a pump for the fluid power source, in which little pulsation occurs, with an accumulator and a throttle mechanism.

DESCRIPTION OF THE PREFERRED EMBODIMENTS

Now a hydrostatic speaker and a speaker driver according to the present invention will be described with reference to the accompanying drawings.

Figure 1:
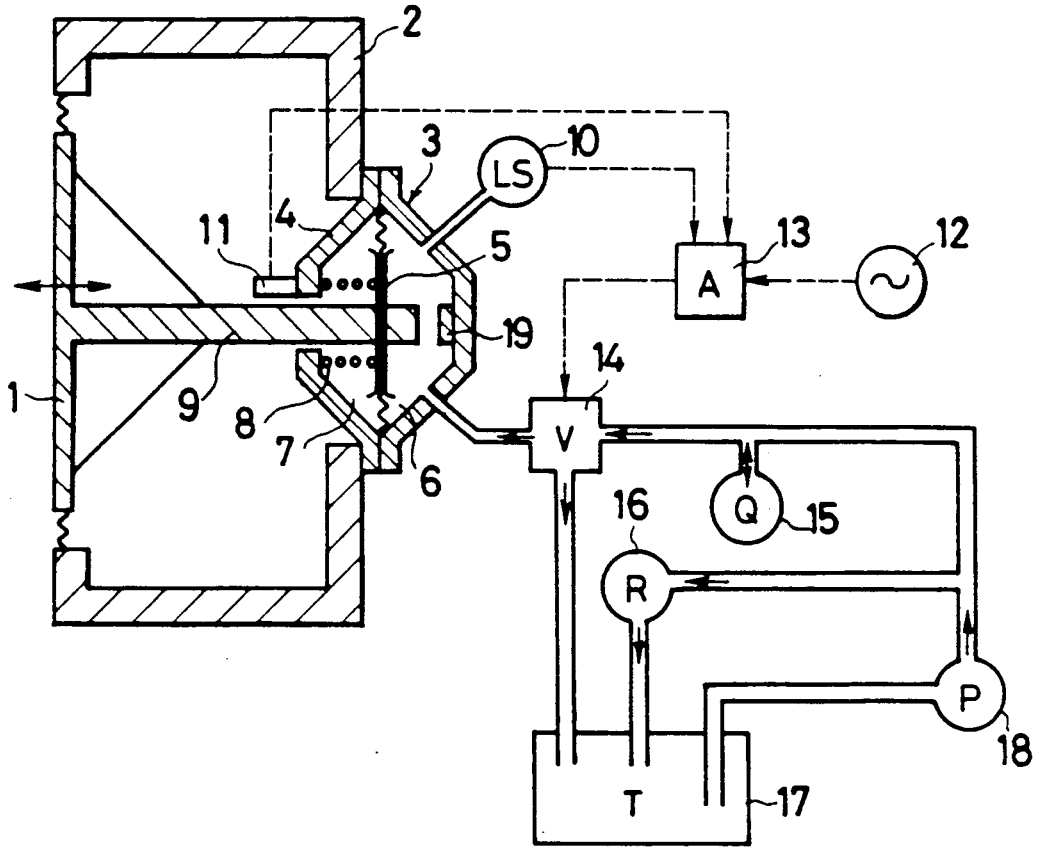
FIG. 1 is a view showing one embodiment of a hydrostatic speaker and a speaker driver according to the present invention.

The hydrostatic speaker and the speaker driver shown in FIG. 1 are comprised of the following four sections. The first section comprises a core 1 and a cabinet 2 for efficient radiation of a low-frequency sound therefrom. The second section includes a hydraulic driver 3 and accessory sensors 10 and 11. The third section is an electric circuit section including a control amplifier 13. The fourth section is a hydraulic circuit including a fluid pressure controller 14.

The core 1 mounted at the front of the cabinet 2 is made of a lightweight material having substantial strength, for example a carbon fiber molding, and constructed so as to vibrate as one body to output a specific sound. For the core 1, a flat board in FIG. 1 of any arbitrary shape, conical for example, may be chosen.

The hydraulic driver 3 mounted at the back of the cabinet 2 is of a construction such that the interior of a oscillator 4 is divided into two chambers, front and rear, by a partition diaphragm 5 which is a moving body disposed at the center thereof, and one chamber, that is, the rear chamber 6 in FIG. 1, serves as a fluid pressure chamber. In the other chamber (front chamber) 7, there is disposed a spring 8 working against the fluid pressure in the fluid pressure chamber 6. In the fluid pressure chamber 6, there is provided a stopper 19 in order to protect the diaphragm 5 from excessive deformation when the fluid pressure therein is small.

The core 1 and the diaphragm 5 are connected with each other by a rod 9 extending through the interior of the cabinet 2.

The hydrostatic speaker is provided with a fluid pressure sensor 10 which detects a pressure in the fluid pressure chamber 6 and a position sensor 11 which detects the movement of the connecting rod 9. Since the connecting rod 9 operates with the diaphragm 5 and the core 1, it is not necessarily required to locate the position sensor 11 in the vicinity of the connecting rod 9, but rather, it may be disposed in the vicinity of the diaphragm 5 or the core 1. Detection signals from the fluid pressure sensor 10 and the position sensor 11 are sent to the control amplifier 13.

The control amplifier 13 controls a fluid pressure controller 14 in accordance with a signal input from a signal source 12. The fluid pressure controller 14 sends an output signal to the hydraulic driver 3 to control the pressure in the fluid pressure chamber 6. The detection signals from the above-mentioned sensors 10 and 11 are additionally input into the control amplifier 13, which in turn changes the signal to be output to the fluid pressure controller 14 for the purpose of proper adjustment of the fluid pressure chamber pressure.

The fluid power source includes a pump 18 of the type causing little pressure noise, for example a screw pump, in order to prevent a fluid power source ripple or to prevent unexpected sound due to the ripple. The pump supplies pressure with little pressure fluctuation to the fluid pressure controller 14 in cooperation with a pressure controller 16 and an accumulator 15.

Next, the operation of the speaker and the speaker driver of the above-mentioned construction will be explained by referring to FIG. 1.

The control amplifier 13 receives an electrical signal, which will be converted to an acoustic sound, from the signal source 12, and then converts it to an electric voltage or current suited to the fluid pressure controller 14 to control the controller 14. As the fluid pressure controlled by the fluid pressure controller 14 is supplied to the fluid pressure chamber 6 of the hydraulic driver 3, the diaphragm 5 moves right and left in accordance with signals from the signal source 12. The movement of the diaphragm 5 is transmitted to the core 1 through the connecting rod 9. The vibration of the core 1 changes air density, thereby producing compression waves. The compression waves are isolated from the diaphragm 5 by the cabinet 2 and the shell 4, so that there is little influence on the diaphragm.

The control amplifier 13, receiving an electrical signal for electro-acoustic conversion from the signal source 12, changes the signal to a variation of the electric voltage or current suitable for driving the controller 14. At the same time, the control amplifier 13 receives, as a correction signal, a pressure signal from the fluid pressure chamber 6 and a positional signal of the connecting rod 9 from the sensors 10 and 11 respectively. The fluid pressure detection signal from the fluid pressure sensor 10 is used not only to control the fluid pressure so that the fluid pressure properly follows the electrical signal but to control the fluid pressure of the hydraulic driver 3 so that unexpected pressure vibration in the pressure source is not radiated as a sound. Also, the signal from the position sensor 11 for detecting the connecting rod 9 is used to improve a neutral position holding function where no electric signal is present and to improve a follow-up function as it is differentiated to speed and acceleration. The velocity and acceleration may be obtained by separator sensors.

It is desirable that the control amplifier be provided with a phase compensating circuit and a frequency characteristics compensating circuit in order to improve the characteristics of the hydrostatic speaker.

A fluid tank 17, the pump 18, the accumulator 15, the pressure regulator 16 and the fluid pressure controller 14 are conventional in the art and therefore need not be explained herein, although it is imperative to employ those which are of low noise, little fluid pressure fluctuation, little temperature rise and high efficiency in order to accomplish the objects of the present invention. Also, the use of small, lightweight devices and a closed fluid circuit should be taken into account for easy movement of the hydrostatic speaker and the fluid devices.

Next, another embodiment of the present invention will be explained by referring to FIG. 2.

Figure 2:
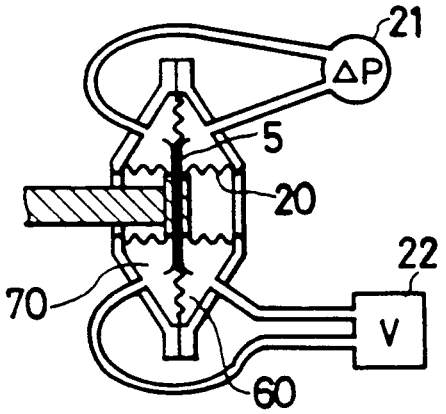
FIG. 2 is a view showing another embodiment of a fluid pressure driver of the hydrostatic speaker.

The embodiment in FIG. 2 shows a differential-pressure-type hydraulic driver having pressure chambers 60 and 70 on both sides of the diaphragm 5. In this driver construction, the spring 8 and the stopper 19 shown in FIG. 1 are not employed, but a bellows seal 20 is provided in their place to seal the fluid pressure chambers 60 and 70. The above-mentioned fluid pressure sensor 10 has been changed to a differential pressure sensor 21, and the fluid pressure controller 14 also has been replaced by a fluid pressure controller 22 which produces the proper pressure difference between the pressure chambers 60 and 70.

Figure 3:
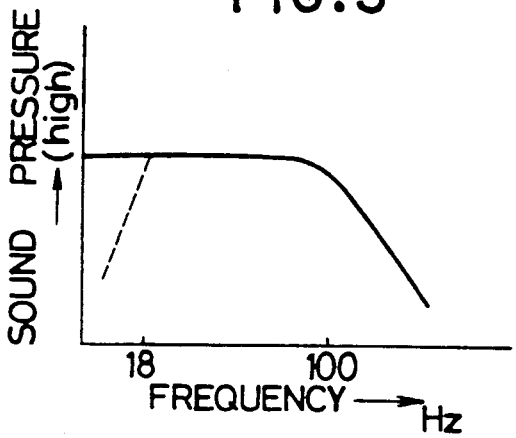
FIG. 3 is a graph showing the frequency-sound pressure characteristics of the speaker according to the present invention.
Figure 4:
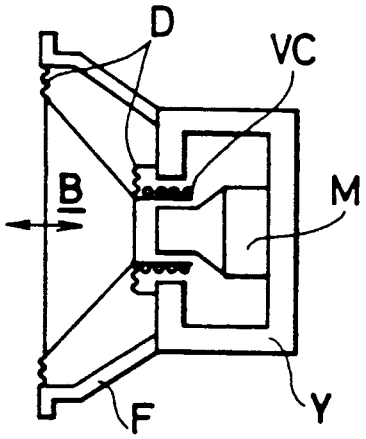
FIG. 4 schematically illustrates a conventional dynamic speaker.
Figure 5:
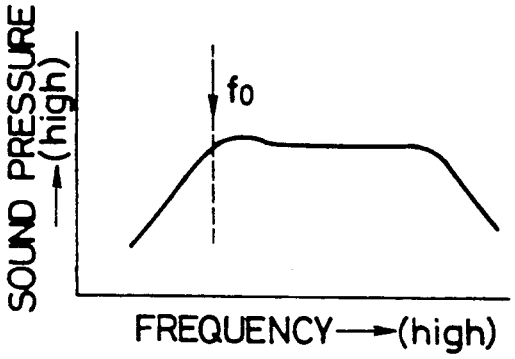
FIG. 5 is a graph showing the frequency-sound pressure characteristics of the speaker of FIG. 4.

FIG. 3 shows the frequency-sound pressure characteristics of the fluid hydrostatic speaker of FIG. 2. As indicated by the full line, it is understood that a sound in a super low-frequency range from nearly about 0 Hz is powerfully radiated. A dotted line indicates an extremely low-frequency range, for example 18 Hz or lower, to be artificially cut so that no excessive amplitude of frequency would occur.

In the case of a construction having a single fluid chamber and a spring which works against the fluid pressure as shown in FIG. 1, the speaker has a resonance frequency given by the mass and spring and vibration system, but can be given characteristics similar to those shown in FIG. 2 by effecting an appropriate feedback control.

As compared with a conventional dynamic speaker having high-pass (high-range pass, low-range attenuation) frequency-sound pressure characteristics, the hydrostatic speaker of the present invention has low-pass (low-range pass, high-range attenuation) characteristics; therefore, it is possible to form a wide-band acoustic system by using the speaker in combination with the conventional speaker. Particularly, at an outdoor rock concert for instance, attenuation is commonly done in a low-frequency range of below about 80 Hz; however, since the hydrostatic speaker radiates an extremely low sound which the audience can feel as air pressure, a much more powerful acoustic effect can be obtained when used at outdoor music concerts.

When a hydraulic driver is used to produce a sound, a pressure variation in the fluid power source becomes noise, spoiling the sound qualities. The hydraulic speaker of the above-described embodiment, however, can produce a clear sound without noise because it uses a low-speed screw pump for the pump 18 which hardly produces pulsation, and the fluid pressure chamber pressure of the driver 3 or the pressure difference between two pressure chambers 60 and 70 is fed back.

In the above-mentioned two embodiments, the hydraulic driver for the speaker is of a diaphragm-type construction, but it is to be understood that the driver is not limited to the diaphragm type. It may be constructed of other types based on a similar principle, for instance a piston type, a bellows type, etc., as long as the expected functional effects are obtained.

What is claimed is:

1. A hydraulic speaker of the type having a speaker driver and a core for radiating acoustic sound in response to external signals, comprising:

an oscillator and a moving body, the oscillator being divided into a front section and a rear section by the moving body, one of the sections serving as a fluid pressure chamber to vibrate said moving body in accordance with the external signals, and wherein said core is connected with said moving body such that said core radiates a low-frequency sound, said hydrostatic speaker further including a fluid pressure sensor for detecting a pressure in said fluid pressure chamber or a pressure in a pipe connected to said fluid pressure chamber wherein the speaker driver includes a fluid pressure controller connected to a fluid power source to control the fluid pressure of the fluid pressure chamber, and a control amplifier for controlling said fluid pressure controller in accordance with the external signals, and inputting into said control amplifier a detection signal from the fluid pressure sensor as a feedback signal for improving controllability and for preventing the occurrence of noise due to variations in the fluid source pressure.

2. The hydrostatic speaker of claim 1, including a position sensor for detecting the position of said moving body or another element which moves with said moving body, and wherein a detection signal from said position sensor is input as a feedback signal to said control amplifier in order to improve response qualities and the neutral position holding function of said moving body when no signal is present.

3. The hydrostatic speaker of claim 1, wherein said fluid power source is provided with a pump which operates substantially free of pulsation, an accumulator and a pressure controller.

4. The hydrostatic speaker of claim 1, wherein said control amplifier is provided with a phase compensating circuit and a frequency characteristics compensating circuit in order to improve the characteristics of said hydrostatic speaker.

5. The hydrostatic speaker of claim 2, wherein said control amplifier is improved with a phase compensating circuit and a frequency characteristics compensating circuit in order to improve the characteristics of said hydrostatic speaker.

6. The hydrostatic speaker of claim 2, wherein said fluid power source is provided with a pump which operates substantially free of pulsation, an accumulator and a pressure controller.

7. The hydrostatic speaker of claim 2, including a velocity sensor for detecting the velocity of the moving body or another element which moves with the moving body, and wherein a detection signal from said velocity is further inputted as feedback signal, in addition to a position signal from the position sensor, to said control amplifier in order to improve response qualities and the center position holding function of said moving body when no signal is present.

8. The hydrostatic speaker of claim 2, including an accelerator sensor for detecting the acceleration of the moving body or another element which moves with the moving body.

9. The hydrostatic speaker responsive to external signals, comprising:

an oscillator and a moving body therein, the oscillator being divided into a front section and a rear section by the moving body, both of said sections respectively serving as a fluid pressure chamber to vibrate said moving body in accordance with the external signals, said speaker further including a core connected with said moving body such that it radiates a low frequency sound, said hydrostatic speaker further including a differential pressure sensor for detecting a pressure difference between said two pressure chambers or a pressure difference in a pipe connected to said fluid pressure chambers and a differential pressure-type fluid pressure controller connected to a fluid power source to control a differential pressure between two fluid pressure chambers, and a control amplifier for controlling said fluid pressure controller in accordance with a signal, and inputting into said control amplifier a detection signal from the differential pressure sensor as a feedback signal for improving controllability and for preventing the occurrence of noise occurring due to variations in the fluid source pressure.

10. The hydrostatic speaker of claim 9, including a position sensor for detecting the position of said moving body or another element which moves with said moving body, and wherein a detection signal from said position sensor is inputted as a feedback signal to said control amplifier in order to improve response qualities and the neutral position holding function of said moving body when no signal is present.

11. The hydrostatic speaker of claim 9, wherein said fluid power source is provided with a pump which operates substantially free of pulsation, an accumulator and a pressure controller.

12. The hydrostatic speaker of claim 9, wherein said control amplifier is provided with a phase compensating circuit and a frequency characteristics compensating circuit in order to improve the characteristics of said hydrostatic speaker.

13. The hydrostatic speaker of claim 10, wherein said fluid power source is provided with a pump which operates substantially free of pulsation,, an accumulator and a pressure controller.

14. The hydrostatic speaker of claim 10, wherein said control amplifier is provided with a phase compensating circuit and a frequency characteristics compensating circuit in order to improve the characteristics of said hydrostatic speaker.

15. The hydrostatic speaker of claim 10, including a velocity sensor for detecting the velocity of the moving body or another element which moves with the moving body, and wherein a detection signal from said velocity is further inputted as a feedback signal, in addition to a position signal from the position sensor, to said controller amplifier in order to improve response qualities and the center position holding function of said moving body when no signal is present.

16. The hydrostatic speaker of claim 10, including an accelerator sensor for detecting the acceleration of the moving body or another element which moves with the moving body.

* * * * *

UNITED STATES PATENT AND TRADEMARK OFFICE

CERTIFICATE OF CORRECTION

PATENT NO. : 5,060,274

DATED : October 22, 1991

INVENTOR(S) : Shuji Asami and Hitoshi Kitayama

It is certified that error appears in the above-identified patent and that said Letters Patent is hereby corrected as shown below:

Column 6, line 9, change "hydraulic" to --hydrostatic--.

Column 8, line 14, change ",," to --,--.

Signed and Sealed this

Second Day of March, 1993

*Attest:*

STEPHEN G. KUNIN

*Attesting Officer*

*Acting Commissioner of Patents and Trademarks*